US011404782B2

(12) United States Patent
Wang et al.

(10) Patent No.: US 11,404,782 B2
(45) Date of Patent: Aug. 2, 2022

(54) ELECTRONIC DEVICE

(71) Applicant: Lenovo (Beijing) Co., Ltd., Beijing (CN)

(72) Inventors: Wei Wang, Beijing (CN); Zhiyuan Duan, Beijing (CN)

(73) Assignee: LENOVO (BEIJING) CO., LTD., Beijing (CN)

( * ) Notice: Subject to any disclaimer, the term of this patent is extended or adjusted under 35 U.S.C. 154(b) by 68 days.

(21) Appl. No.: 16/370,037

(22) Filed: Mar. 29, 2019

(65) Prior Publication Data

US 2019/0305424 A1 Oct. 3, 2019

(30) Foreign Application Priority Data

Mar. 30, 2018 (CN) ..... 201810291520.0

(51) Int. Cl.
*H01Q 1/27* (2006.01)
*H01Q 5/15* (2015.01)
*H01Q 1/48* (2006.01)

(52) U.S. Cl.
CPC ..... *H01Q 5/15* (2015.01); *H01Q 1/273* (2013.01); *H01Q 1/48* (2013.01)

(58) Field of Classification Search
CPC ..... H01Q 5/15; H01Q 1/273; H01Q 1/48; H01Q 1/22; H01Q 1/36; H01Q 1/50; H01Q 21/00; H01Q 5/321; H01Q 9/42
See application file for complete search history.

(56) References Cited

U.S. PATENT DOCUMENTS

| | | | | |
|---|---|---|---|---|
| 2014/0210682 | A1 | 7/2014 | Kao et al. | |
| 2017/0179581 | A1* | 6/2017 | Puuri | H01Q 7/005 |
| 2017/0264018 | A1* | 9/2017 | Hu | H01Q 1/242 |
| 2018/0062249 | A1* | 3/2018 | Sung | H05K 7/1427 |

FOREIGN PATENT DOCUMENTS

| | | | |
|---|---|---|---|
| CN | 101273493 | A | 9/2008 |
| CN | 103579755 | A | 2/2014 |
| CN | 105098354 | A | 11/2015 |
| CN | 204760528 | U | 11/2015 |
| CN | 105337040 | A | 2/2016 |
| CN | 105449364 | A | 3/2016 |
| CN | 105576370 | A | 5/2016 |
| CN | 106159443 | A | 11/2016 |
| CN | 107546461 | A | 1/2018 |
| CN | 207149698 | U | 3/2018 |

* cited by examiner

*Primary Examiner* — David E Lotter
(74) *Attorney, Agent, or Firm* — Anova Law Group, PLLC

(57) ABSTRACT

An electronic device includes a radiator, a first antenna, and a second antenna. The first antenna radiates a radio frequency (RF) signal of a first frequency band by using a first portion of the radiator and the second antenna radiates the RF signal of a second frequency band by using a second portion of the radiator. The second portion includes the first portion.

10 Claims, 12 Drawing Sheets

ELECTRONIC DEVICE

CROSS-REFERENCE TO RELATED APPLICATION

This application claims priority to Chinese Application No. 201810291520.0, filed on Mar. 30, 2018, the entire content of which is incorporated herein by reference.

FIELD OF THE DISCLOSURE

The present disclosure relates to an electronic device.

BACKGROUND

Wearable devices, such as smart watches, are challenging for antenna designs supporting multi-format and multi-band transmissions because the size of the devices is generally small.

Currently, one of the conventional technologies is to add an active component to the antenna design, such that the antenna can support as many frequency bands and formats as possible. However, during a switching process of the active device, only a certain frequency band or format will be guaranteed, and the requirement of multi-band and multi-format working simultaneously will not be satisfied. In another conventional technology, the wearable device utilizes two antenna branches, e.g., a left antenna branch and a right antenna branch, to solve the problem of multi-band and multi-format working simultaneously. However, the design having two antenna branches on the left and right of the device causes the size of the device to be large and reduces the competitiveness of the product.

SUMMARY

In accordance with the disclosure, an electronic device includes a radiator, a first antenna, and a second antenna. The first antenna radiates a radio frequency (RF) signal of a first frequency band by using a first portion of the radiator and the second antenna radiates the RF signal of a second frequency band by using a second portion of the radiator. The second portion includes the first portion.

Also in accordance with the disclosure, a dual-band antenna includes a first antenna and a second antenna. The first antenna radiates a radio frequency (RF) signal of a first frequency band by using a first portion of the radiator and the second antenna radiates the RF signal of a second frequency band by using a second portion of the radiator. The second portion includes the first portion.

Also in accordance with the disclosure, an electronic device includes a radiator and a dual-band antenna arranged at the radiator. The dual-band antenna includes a first antenna and a second antenna. The first antenna radiates a radio frequency (RF) signal of a first frequency band by using a first portion of the radiator and the second antenna radiates the RF signal of a second frequency band by using a second portion of the radiator. The second portion includes the first portion.

BRIEF DESCRIPTION OF THE DRAWINGS

In order to provide a clearer illustration of the present disclosure, brief descriptions of the drawings of the present disclosure are provided.

DETAILED DESCRIPTION

Figure 1:
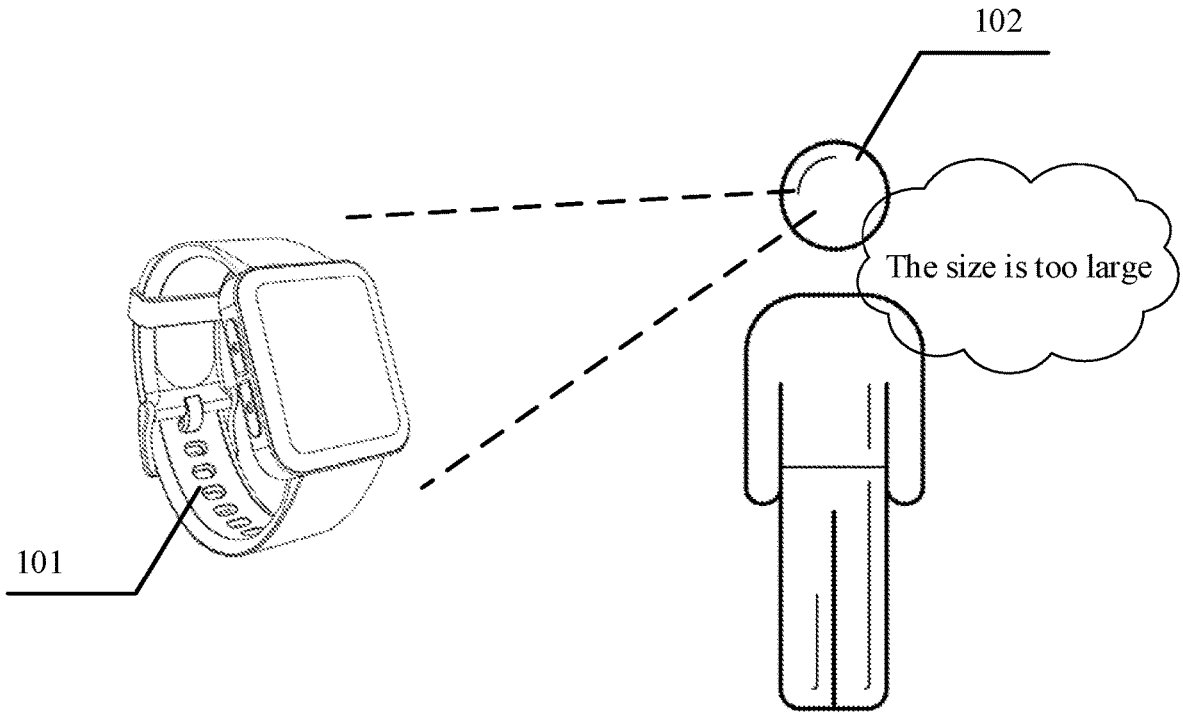
FIG. 1 schematically shows an application scenario of an electronic device according to the disclosure.

Hereinafter, embodiments of the present disclosure are described with reference to the drawings. It is apparent that the disclosed embodiments are merely exemplary and not intended to limit the scope of the disclosure. Details will be illustrated to provide a thorough understanding of embodiments of the disclosure. However, it will be appreciated that one or more embodiments without the disclosed details may be implemented. In addition, descriptions of well-known structures and technologies are omitted herein to avoid unnecessarily obscuring the concept of the disclosure.

The terminologies used herein are merely for illustration, and are not intended to limit the disclosure. The terms "including," "comprising," and variations thereof herein indicate the presence of the features, steps, processes, and/or components, but are not intended to exclude the presence or addition of one or more other features, steps, processes, or components.

Unless otherwise defined, all the technical and scientific terms used herein have the same or similar meanings as generally understood by one of ordinary skill in the art. The terms used herein are to be interpreted as having a meaning consistent with the context of the specification and should not be interpreted in an ideal or too rigid manner.

As described herein, an expression similar to "at least one of A, B, and C" should be generally interpreted in accordance with the meaning of the expression as generally understood by those skilled in the art. For example, "a system having at least one of A, B, and C" may include, but is not limited to, the system having A alone, B alone, C alone, both A and B, both A and C, both B and C, and/or all of A, B, and C. It will also be appreciated by those skilled in the art that any transitional conjunction and/or phrase representing two or more associated objects in the specification, claims, or drawings, may include anyone of the possibilities, e.g., any one or two of the associated objects. For example, A or B may represent including one of three possibilities, i.e., A alone, B alone, and both A and B.

Currently, wearable devices, such as smart watches, are challenging for the antenna designs supporting multi-format and multi-band transmissions, because the size of the devices is generally small. One of the conventional technologies is to add an active component to the antenna design, such that the antenna can support as many frequency bands and formats as possible. However, during a switching process of the active device, only a certain frequency band or format can be guaranteed, and the requirement of multi-band and multi-format working simultaneously cannot be satisfied. In another conventional technology, the wearable device utilizes two antenna branches, e.g., a left antenna branch and a right antenna branch, to solve the problem of multi-band and multi-format working simultaneously. However, the design having two antenna branches on the left and right of the device can cause the size of the device to be large and reduce the competitiveness of the product.

An electronic device consistent with the disclosure is provided. The electronic device can include a radiator, a first antenna, and a second antenna. The first antenna can radiate a radio frequency (RF) signal of a first frequency band by using a first portion of the radiator, and the second antenna can radiate the RF signal of a second frequency band by using a second portion of the radiator. The second portion belongs to the first portion. Therefore, the structure of the electronic device can be more compact by multiplexing the second antenna with a portion of the first antenna, such that the problem that the use of the left and right antenna branches causes the size of the device to be large and reduces the competitiveness of the product can be solved.

FIG. 1 schematically shows an application scenario of an electronic device 101 consistent with the disclosure. It will be appreciated that FIG. 1 is merely an example of the application scenario of the present disclosure and is intended to help those skilled in the art to understand the technical content of the present disclosure, but does not mean that the embodiment of the present disclosure cannot be applied to other devices, systems, environments, or scenarios.

With the development of science and technology, users are increasingly demanding the functions of the electronic devices. For example, if the electronic device can communicate, the user may desire that the electronic device has a function of simultaneously supporting the multi-band and multi-format. For example, the user is using the electronic device to download data via a WiFi network (the WiFi network can use the WiFi frequency band to transmit a RF signal) and the user wants to use GPS on the electronic device to locate a current location at the same time, i.e., the user wants the electronic device to support the WiFi frequency band and the GPS frequency band to work at the same time. Currently, the wearable device utilizes two antenna branches, e.g., a left antenna branch and a right antenna branch, to solve the problem of multi-band and multi-format working simultaneously. However, the design having two antenna branches on the left and right of the device can cause the size of the device to be large and reduce the competitiveness of the product.

As shown in FIG. 1, if the electronic device 101 is a smart watch, when a user 102 wants to purchase the electronic device 101 supporting multi-band and multi-format at the same time, due to the large size of the electronic device 101, the aesthetics of the electronic device 101 is poor, the comfort of the electronic device 101 is low, and the like, therefore, the user 102 is likely to give up the purchase, thereby seriously affecting the market competitiveness of the electronic device 101.

Consistent with the disclosure, the electronic device 101 can include the radiator, the first antenna, and the second antenna. The first antenna can radiate the RF signal of the first frequency band by using the first portion of the radiator, and the second antenna can radiate the RF signal of the second frequency band by using the second portion of the radiator. The second portion belongs to the first portion. Therefore, the problem that the solution adopted by the conventional technology is easy to cause the size of the device to be too large can be solved.

Hereinafter, embodiments of the present disclosure are described with reference to the drawings.

In accordance with the disclosure, there is provided the electronic device including the radiator, the first antenna, and the second antenna. The first antenna can radiate the RF signal of the first frequency band by using the first portion of the radiator, and the second antenna can radiate the RF signal of the second frequency band by using the second portion of the radiator. The second portion belongs to the first portion.

In some embodiments, the electronic device may include a mobile phone, a tablet, a notebook, a wearable device, or the like. The wearable device may include, for example, a smart watch, a wristband product, glasses, or the like, which is not limited herein.

According to the disclosure, the radiator refers to an object capable of emitting radiation. The radiation refers to that the radiator can transmit power outwardly through electromagnetic waves. The radiator may include, for example, a metal frame of the electronic device.

In some embodiments, the frequency band can be used to indicate the frequency range, and different frequency bands can indicate different frequency range. For example, the frequency range of the WiFi frequency band can be 2400 MHz-2480 MHz, the frequency range of the GPS frequency band can be 1560 MHz-1592 MHz, and the frequency range of the B40 frequency band can be 2300 MHz-2400 MHz, and the frequency range of the B41 band can be 2496 MHz-2690 MHz.

According to the disclosure, the RF may include an electromagnetic wave frequency band that can be radiated into the space, and the RF band may range from 300 kHz to 300 GHz, such that the WiFi frequency band, the GPS frequency band, the B40 frequency band, and the B41 frequency band may all belong to the RF band.

In some embodiments, the first antenna can radiate the RF signal of the first frequency band by using the first portion of the radiator, and the second antenna can radiate the RF signal of the second frequency band by using the second portion of the radiator. The second portion belongs to the first portion. The first frequency band may include the GPS frequency band, and the second frequency band may include the WiFi frequency band.

Figure 2:
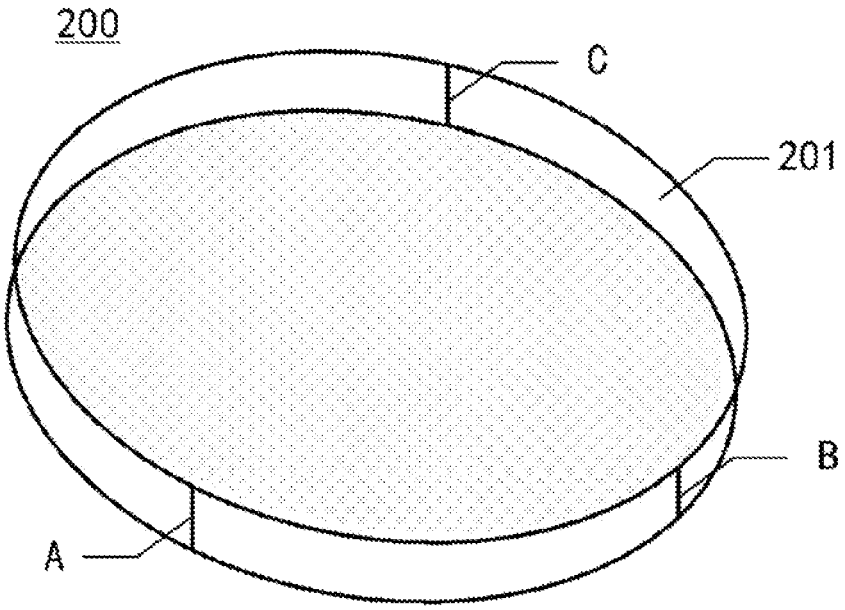
FIG. 2 is a schematic diagram of an electronic device according to the disclosure.

FIG. 2 is a schematic diagram of an electronic device 200 consistent with the disclosure.

As shown in FIG. 2, the electronic device 200 includes a radiator 201. Assume that the electronic device 200 is the smart watch, the radiator 201 can be a metal frame of the smart watch. A distance from a point A to a point C in the counterclockwise direction may be the first portion of the radiator 201, and the distance from a point A to a point B in the counterclockwise direction may be the second portion of the radiator 201. In this scenario, the first antenna may use the first portion to radiate the RF signal of the first frequency band, for example, the RF signal of the GPS frequency band, and the second antenna may use the second portion to radiate the RF signal of the second frequency band, for example, the RF signal of the WiFi frequency band.

Consistent with the disclosure, the first antenna can radiate the RF signal of the first frequency band by using the first portion of the radiator, and the second antenna can radiate the RF signal of the second frequency band by using the second portion of the radiator. The second portion can belong to the first portion. That is, the structure of the electronic device can be more compact by multiplexing the second antenna with a portion of the first antenna, such that the problem that the use of the left and right antenna branches causes the size of the device to be large and reduces the competitiveness of the product can be solved.

In some embodiments, the first antenna and the second antenna can be in the operating state at the same time.

In some embodiments, the first antenna and the second antenna may be in the operating state at the same time. For example, assume that the first antenna is used to transmit the RF signal of the GPS frequency band, and the second antenna is used to transmit the RF signal of the WiFi frequency band. The first antenna and the second antenna being in the operating state at the same time can include the electronic device can simultaneously transmit signals using the GPS frequency band and the WiFi frequency band. For example, the electronic device can simultaneously use the GPS frequency band to locate the current location, and use the WiFi frequency band to download data.

In some embodiments, the electronic device can also transmit data using the first antenna alone. For example, the electronic device can separately transmit the RF signal of the GPS frequency band using the first antenna to, for example, locate the current location.

In some embodiments, the electronic device can also transmit data using the second antenna alone. For example, the electronic device can separately transmit the RF signal of the WiFi frequency band using the second antenna to, for example, download the data.

According to the disclosure, under the premise of reducing the size of the electronic device, it is further ensured that the first antenna and the second antenna can be in the operating state at the same time, thereby not only achieving the purpose of reducing the size of the electronic device, but also enabling the electronic device to support multi-band and multi-format at the same time.

In some embodiments, the electronic device can further include a load circuit arranged at the radiator.

In some embodiments, the load circuit can be an end of the second portion distal from the first portion, e.g., the point B.

In some embodiments, the load circuit can include at least one load circuit. When the load circuit includes one load circuit, the electronic device can support two frequency bands, such as the first frequency band and the second frequency band, simultaneously in the operating state. When the load circuit includes a plurality of load circuits, the electronic device can support three or more frequency bands simultaneously in the operating state, for example, the GPS frequency band, the WLAN frequency band, and some frequency bands of the cellular network (for example, the B40 frequency band and the B41 frequency band).

In some embodiments, the load circuit can be arranged at the radiator for opening the RF signal of the first frequency band and short-circuiting the RF signal of the second frequency band. For example, one end of the load circuit can be arranged at the radiator and another end can be grounded, for example, connected to a ground point on a PCB of the electronic device.

In some embodiments, the load circuit can be used as the end of the second portion. Through the function of the load circuit for opening the RF signal of the first frequency band and short-circuiting the RF signal of the second frequency band, not only the second antenna can be multiplexed with a portion of the first antenna, but also the first frequency band and the second frequency band can be simultaneously in the operating state.

For example, assume that the first antenna is transmitting the RF signal of the first frequency band, the RF signal of the first frequency band can continue to radiate along the first portion because the load circuit is open to the RF signal of the first frequency band. Assume that the second antenna is transmitting the RF signal of the second frequency band, because the load circuit is short-circuiting the second antenna, the position of the load circuit arranged at the radiator is equivalent to the ground point, and because the load circuit is the end of the second portion, the second antenna can be ensured to radiate the RF signal of the second frequency band by using the second portion of the radiator.

Figure 3A:
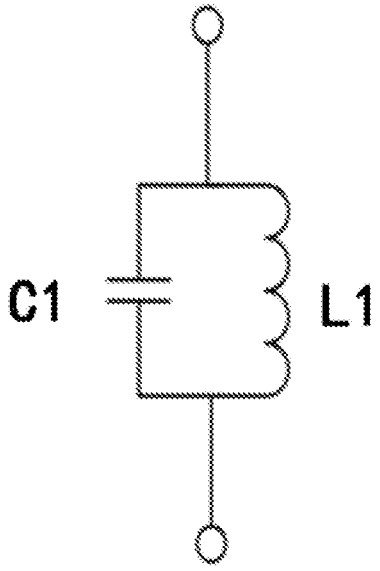
FIG. 3A is a schematic diagram of a topology of a load circuit according to the disclosure.

FIG. 3A is a schematic diagram of a topology of the load circuit consistent with the disclosure.

In some embodiments, the load circuit can include, but is not limited to, an inductor-capacitor (LC) oscillating circuit whose oscillating frequency can be adjusted according to the frequency at which the LC oscillating circuit allows to pass. In some embodiments, as shown in FIG. 3A, the oscillation frequency of the LC oscillating circuit (which is represented by an inductor L1 and a capacitor C1) can be adjusted according to the second frequency band, which is not limited in the disclosure.

Figure 3B:
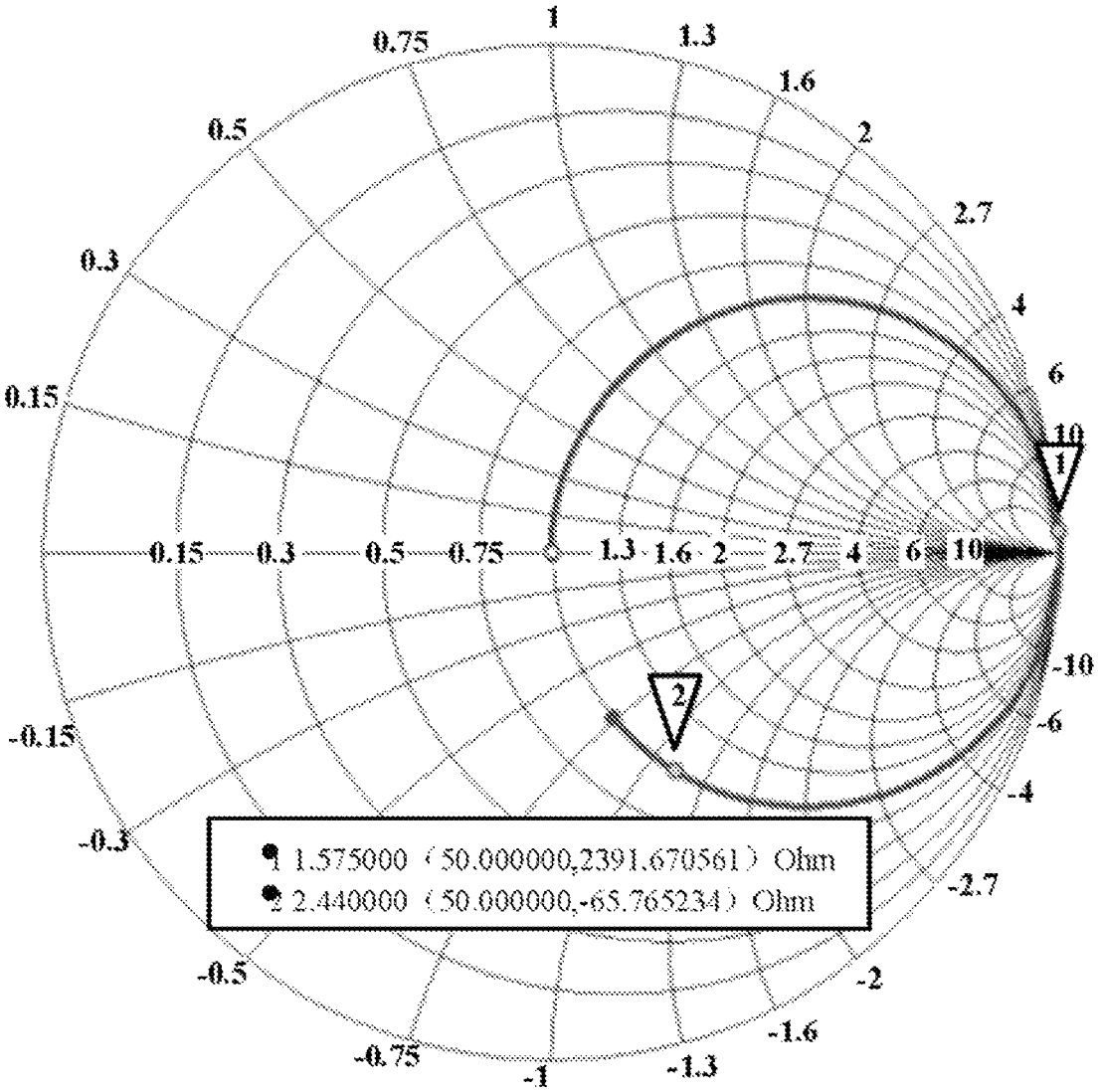
FIG. 3B is a schematic diagram of an impedance curve of a load circuit according to the disclosure.

FIG. 3B is a schematic diagram of an impedance curve of the load circuit consistent with the disclosure.

In some embodiments, as shown in FIG. 3B, 1575 MHz can be an intermediate frequency of the WiFi frequency band, and 2440 MHz can be the intermediate frequency of the GPS frequency band. As shown in FIG. 3B, an imaginary portion of the impedance of the LC oscillating circuit corresponding to the WiFi frequency band is positive (i.e., 2391.670561), and the imaginary portion of the impedance of the LC oscillating circuit corresponding to the GPS frequency band is negative (i.e., −65.765234), which indicate that the LC oscillating circuit allows the RF signal of the WiFi frequency band to pass but blocks the RF signal of the GPS frequency band.

Figure 3C:
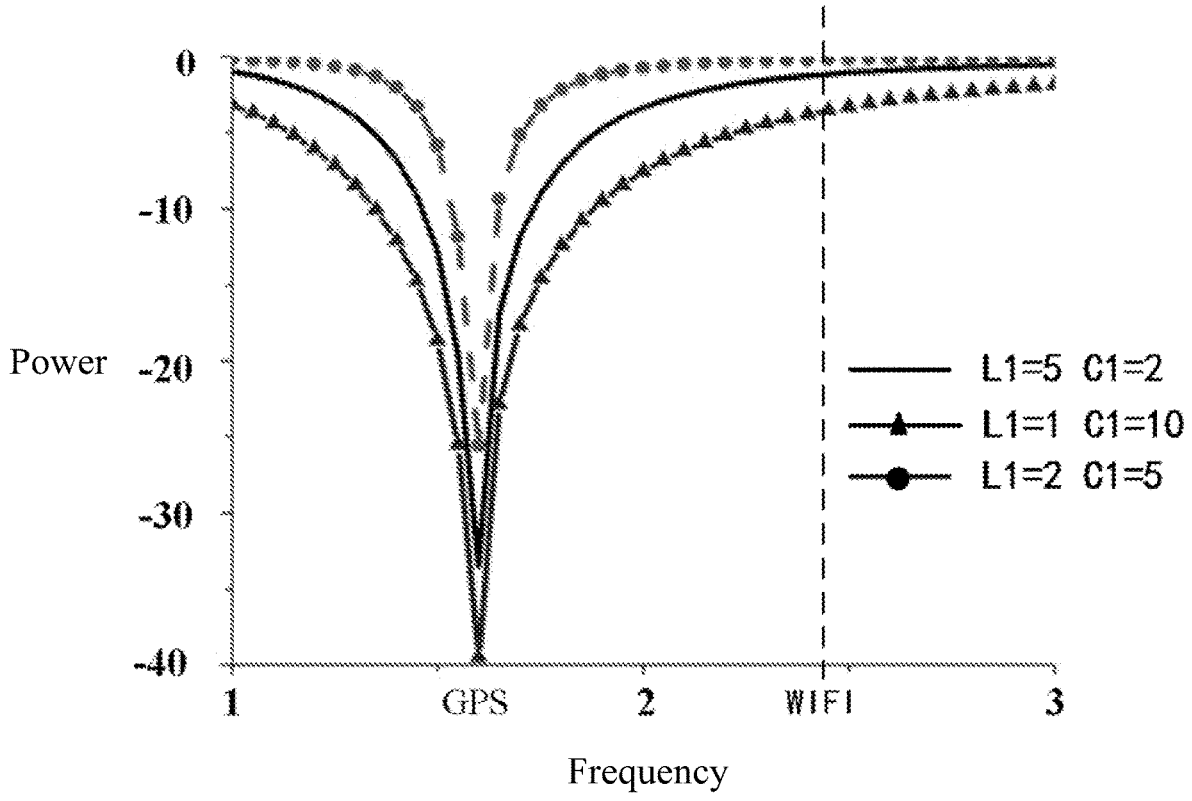
FIG. 3C is a schematic diagram of a transmission coefficient curve of a load circuit according to the disclosure.

FIG. 3C is a schematic diagram of a transmission coefficient curve of the load circuit consistent with the disclosure.

In some embodiments, assume that the load circuit is the LC oscillating circuit, a transmission performance of the LC oscillating circuit can be related to the inductor L and the capacitor C. According to the disclosure, after the oscillating frequency of the LC oscillating circuit is determined, the performance of the LC oscillation circuit can be further adjusted. FIG. 3C shows the transmission system curve of the LC oscillation circuit when L1=5, C1=2, the transmission system curve of the LC oscillation circuit when L1=1, C1=10, and the transmission system curve of the LC oscillation circuit when L1=2, C1=5. As shown in FIG. 3C, the three LC oscillating circuits can block the RF signal of the GPS frequency band, but the LC oscillating circuit with L1=2, the C1=5 can better allow the RF signal of the WiFi frequency band to pass. That is, the performance of the LC oscillating circuit can be optimal when L1=2, C1=5.

According to the disclosure, the load circuit can be arranged at the radiator and the load circuit can be used as the end of the second portion, and the second antenna can be multiplexed with a portion of the first antenna. The second antenna can utilize the second portion of the radiator to radiate the RF signal of the second frequency band, and the first frequency band and the second frequency band can be in the operating state at the same time. That is, not only reducing the size of the electronic device can be achieved, but also multi-band and multi-format can be supported by the electronic devices at the same time.

In some embodiments, the first antenna and the second antenna can share a same feed point, for example, point A.

According to the disclosure, the feed point can be the point at which the signal can be extracted. The "feed" can refer to that a control apparatus sends power to a control point. In some embodiments, the "feed" can refer to that the electronic device can transmit signal power to the feed point, such that the feed point can extract the signal power or the electronic device can receive the signal power introduced by the feed point.

In some embodiments, if the electronic device transmits the data using the RF signal of the first frequency band, the feed point may extract or introduce the RF signal of the first frequency band. If the electronic device transmits the data using the RF signal of the second frequency band, the feed point may extract or introduce the RF signal of the second frequency band.

In some embodiments, the first antenna and the second antenna can share the same feed point, i.e., one feed point can be arranged at the electronic device, and the feed point can extract the RF signal of the first frequency band or the RF of the second frequency band.

In some embodiments, through sharing the same feed point by the first antenna and the second antenna, the second antenna can completely multiplex a portion of the first antenna, thereby greatly reducing the volume and size of the electronic device, and also reducing the number of the feed points and the complexity of electronic device design.

In some embodiments, the feed point may be arranged at the radiator, and the electronic device may further include a ground point arranged at the radiator. The first portion can be the distance from the feed point, e.g., point A, to the ground point, e.g., point C, and the second portion can be the distance between the feed point, e.g., point A, and the load circuit, e.g., point B.

In some embodiments, the feed point can be arranged at the radiator. That is, the RF signal of the first frequency band and the RF signal of the second frequency band can be extracted or introduced from the radiator.

In some embodiments, the radiator can also be provided with the ground point. The first portion can be the distance between the feed point and the ground point, and the second portion can be the distance between the feed point and the load circuit.

In some embodiments, since the first portion and the second portion can use a same starting point, i.e., the common feed point, and the second portion can belong to the first portion, i.e., a length of the second portion can be smaller than the length of the first portion, and the load circuit can be the end of the second portion, therefore, the load circuit can be arranged at the radiator from the feed point to the ground point along the first portion.

In some embodiments, the first portion can be arranged as the distance between the feed point and the ground point, and the second portion can be arranged as the distance between the feed point and the load circuit, such that the second antenna can completely multiplex a portion of the first antenna, thereby reducing the size of the electronic device, and ensuring the electronic device simultaneously supporting multi-band and multi-format. In addition, the opening of the radiator of the electronic device can be avoided by grounding the end of the antenna, and thus an integrity of the radiator of the electronic device can be ensured.

Figure 4:
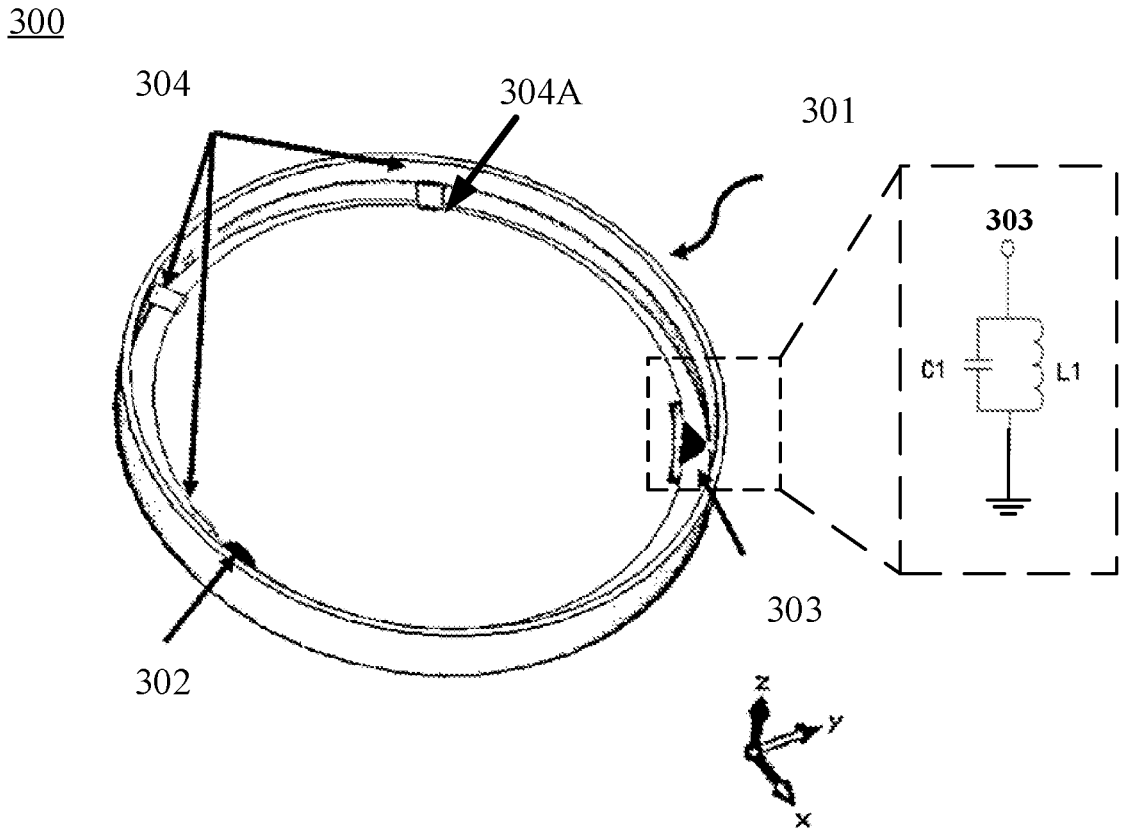
FIG. 4 is a schematic diagram of another electronic device according to the disclosure.

FIG. 4 is a schematic diagram of an electronic device 300 consistent with the disclosure.

As shown in FIG. 4, the electronic device 300 includes a radiator 301. A feed point 302, a load circuit 303, and three ground points 304 are arranged at the radiator 301. The three ground points 304 include a ground point 304A being as the end of the first portion.

The distance between the feed point 302 and the ground point 304A along the counterclockwise direction is the first portion, and the first antenna can use the first portion to radiate the RF signal of the first frequency band. The distance between the feed point 302 to the load circuit 303 along the counterclockwise direction is the second portion. The second portion belongs to the first portion, i.e., the second antenna completely multiplexes a portion of the first antenna.

As shown in FIG. 4, the first antenna shares the same feed point 302 with the second antenna, and the load circuit 303 is arranged at the radiator from the feed point to the ground point along the first portion.

Figure 5A:
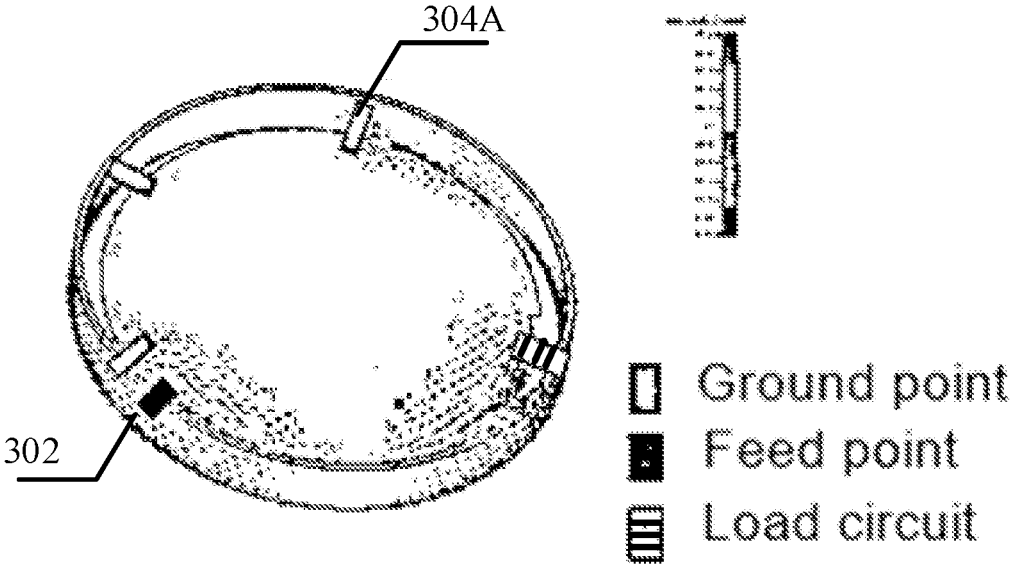
FIG. 5A schematically shows a power distribution of a first antenna according to the disclosure.

FIG. 5A schematically shows a power distribution of the first antenna consistent with the disclosure.

As shown in FIG. 5A, the first portion is the distance between the feed point 302 and the ground point 304A along the counterclockwise direction. When the first antenna is transmitting the RF signal of the first frequency band, the power of the first antenna can be distributed on the first portion.

Figure 5B:
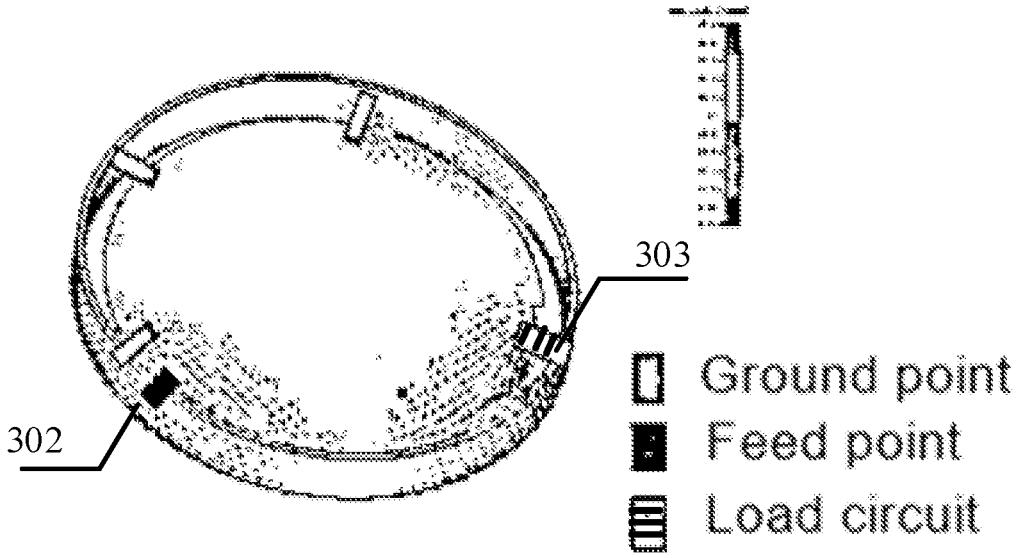
FIG. 5B schematically shows a power distribution of a second antenna according to the disclosure.

FIG. 5B schematically shows a power distribution of the second antenna consistent with the disclosure.

As shown in FIG. 5B, the second portion is the distance between the feed point 302 and the load circuit 303 along the counterclockwise direction, and when the second antenna is transmitting the RF signal of the second frequency band, the power of the second antenna can be distributed on the second portion.

Figure 6:
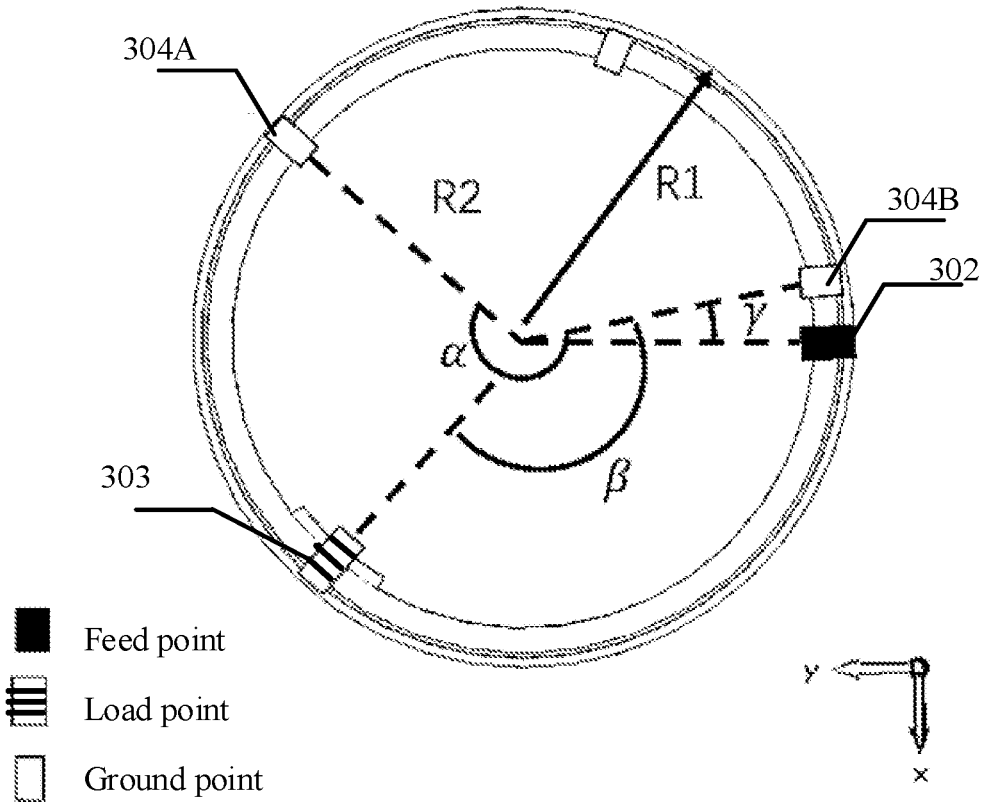
FIG. 6 schematically shows a plan view of an electronic device according to the disclosure.

FIG. 6 schematically shows a plan view of the electronic device consistent with the disclosure.

As shown in FIG. 6, a represents an angle between the feed point 302 and the ground point 304A along the clockwise direction, β represents the angle between the feed point 302 and the load circuit 303 along the clockwise direction, and γ represents the angle between the feed point 302 and the ground point 304B along the counterclockwise direction. The ground point 304B is used to adjust the impedance of the feed point 302. The ground point 304A can be referred to as a first ground point and the ground point 304B can be referred to as a second ground point.

Figure 7A:
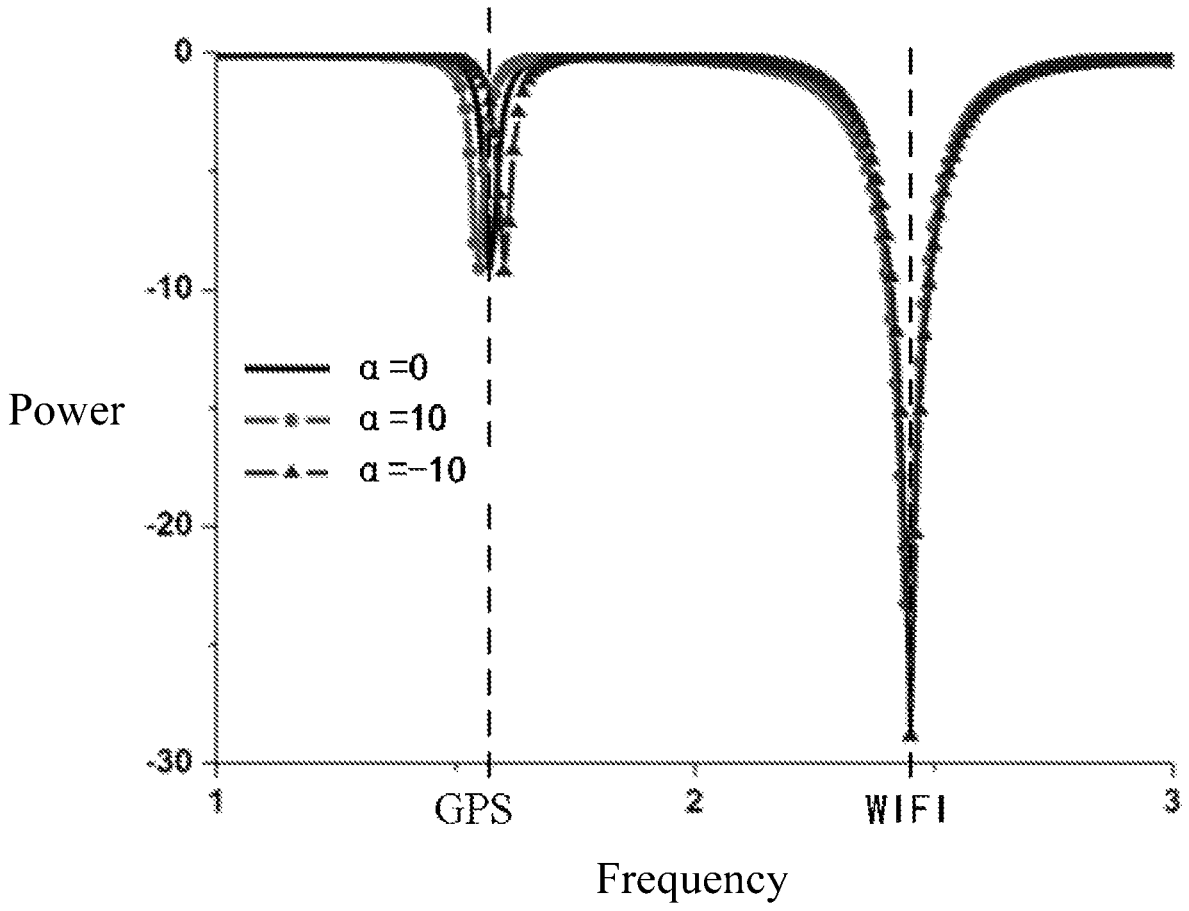
FIG. 7A is a schematic diagram of a return loss curve of an antenna according to an embodiment of the disclosure.

FIG. 7A is a schematic diagram of a return loss curve of the antenna consistent with the disclosure.

As shown in FIG. 7A, assume that the first frequency band transmitted by the first antenna is the GPS frequency band, and the second frequency band transmitted by the second antenna is the WiFi frequency band. The change of a has a great influence on the RF signal of the GPS frequency band transmitted by the first antenna, and has little effect on the RF signal of the WiFi frequency band transmitted the second antenna. That is, the arrangement of the ground point 304A in FIG. 6 has a greater influence on the RF signal of the GPS frequency band transmitted by the first antenna, and has less influence on the RF signal of the WiFi band transmitted by the second antenna.

Figure 7B:
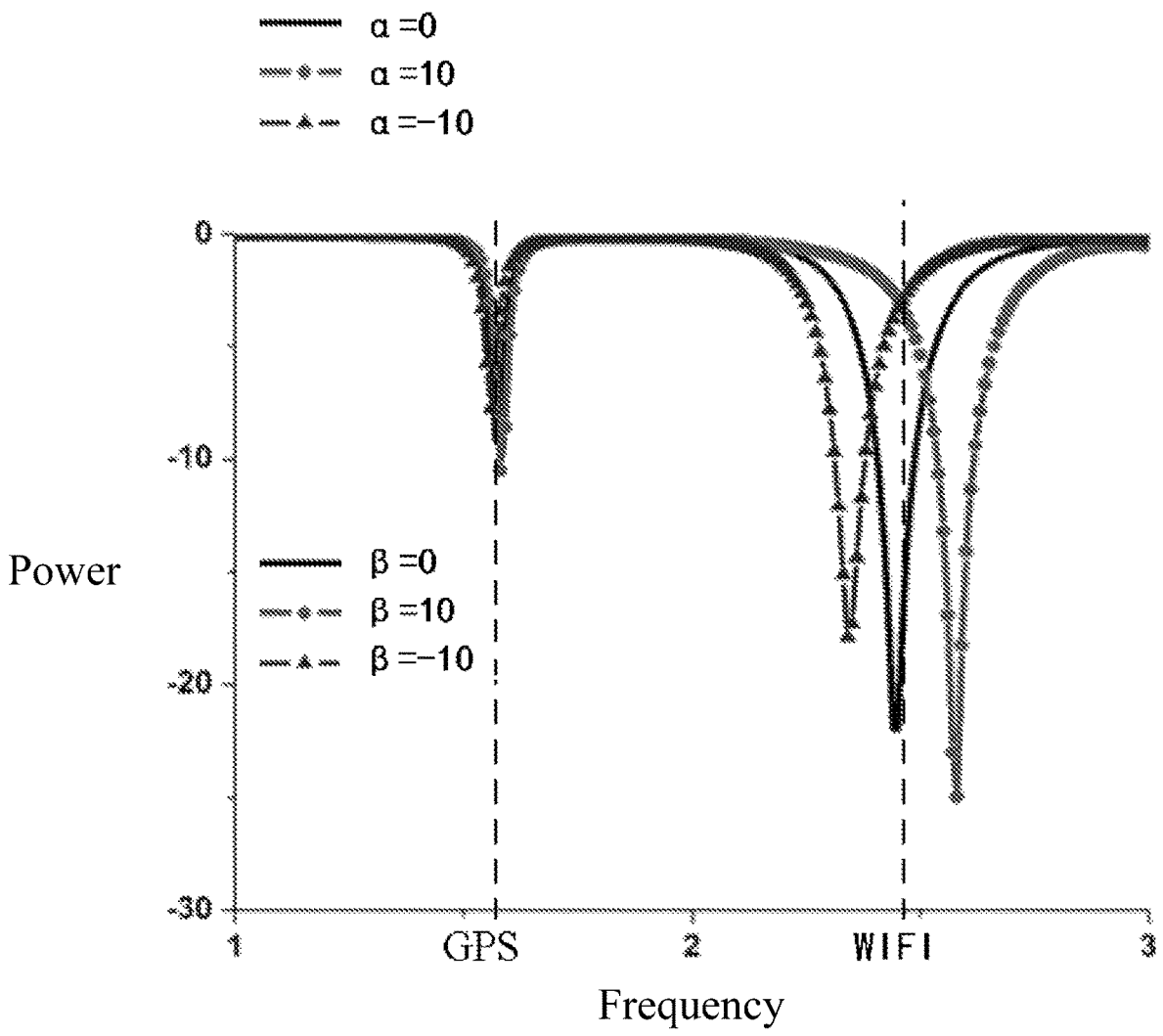
FIG. 7B is a schematic diagram of a return loss curve of an antenna according to another embodiment of the disclosure.

FIG. 7B is a schematic diagram of another return loss curve of the antenna consistent with the disclosure.

As shown in FIG. 7B, assume that the first frequency band transmitted by the first antenna is the GPS frequency band, and the second frequency band transmitted by the second antenna is the WiFi frequency band. The change of β has a little effect on the RF signal of the GPS frequency band transmitted by the first antenna, and has great influence on the RF signal of the WiFi frequency band transmitted the second antenna. That is, the arrangement position of the load circuit 302 in FIG. 6 has a little effect on the RF signal of the GPS frequency band transmitted by the first antenna, and has greater influence on the RF signal of the WiFi band transmitted by the second antenna.

In some embodiments, the arrangement position of the load circuit at the radiator can be determined based on the frequency band to be implemented.

In some embodiments, the position of the load circuit can determine the length of the second portion of the radiator, which directly affects the length of the second antenna.

In some embodiments, different load circuits may pass the RF signals of different frequency bands, and the arrangement position of the load circuit may be determined based on the frequency band to be implemented. In some embodiments, the arrangement position of the load circuit may be determined based on the second frequency band, for example, based on a center frequency of the second frequency band.

According to the disclosure, the position of the load circuit on the radiator can be determined based on the frequency band to be implemented by the load circuit, and the length of the second antenna can be further determined, such that the electronic device can radiate the RF signal of the frequency band by using the second antenna.

In some embodiments, the arrangement position of the load circuit on the radiator can be determined based on a wavelength corresponding to the frequency band to be implemented.

Since the electronic device can transmit the RF signal without opening a slit of the radiator (for example, without opening the slit on the metal frame), the length of the first antenna is required to be not less than half of the wavelength corresponding to the first frequency band and the length of the second antenna is not less than half of the corresponding wavelength of the second frequency band.

In some embodiments, the position of the feed point can be determined first, and the position of a first short-circuit point (for example, the ground point 304A) can be determined along the radiator (for example, the metal frame, also referred to as the antenna radiant section), and the position between the feed point and the short-circuit point is the first antenna. The first antenna can radiate the RF signal of the first frequency band (e.g., the GPS frequency band), and the distance of the first antenna is about half of the wavelength corresponding to the first frequency band. The location of the desired load circuit can be found on the radiator along the feed point, the distance away from the feed point can be about half of the wavelength corresponding to the second frequency band (e.g., the WiFi frequency band). As such, the arrangement position of the load circuit can be determined.

If the distance between the feed point and the short circuit point along the clockwise direction is set as the first antenna, the second antenna can be the distance between the feed point and the arrangement position of the load circuit along the clockwise direction. If the distance between the feed point and the short circuit point along the counterclockwise direction is set as the first antenna, the second antenna can be the distance between the feed point and the arrangement position of the load circuit along the counterclockwise direction.

According to the disclosure, the load circuit (e.g., the LC oscillating circuit) can be tuned, such that the load circuit can be shorted for the second frequency band, and can be opened for other frequency bands, for example, the first frequency band. For example, when the load circuit is arranged at the radiator, one end of the tuned load circuit can be connected to the radiator, and another end of the tuned load circuit can be connected to the ground point. When the first frequency band is working normally, the load circuit can be in an open (close) state for the first frequency band, and the second frequency band can be operated on the radiator between the feed point and the first short circuit point along the counterclockwise or clockwise direction. The load circuit presents a short circuit to the second frequency band, i.e., the arrangement position of the load circuit can be equivalent to the ground point of the second antenna, and the second frequency band can operate on the radiator between the feed point and the arrangement position of the load circuit along the clockwise or counterclockwise direction.

In some embodiments, a second ground point (for example, the ground point 304B) can be provided at the radiator and finely adjust the distance between the second ground point and the feed point, such that the impedance of the feed point can be closer to the system impedance, and thus improve the performance of the feed point.

Figure 8:
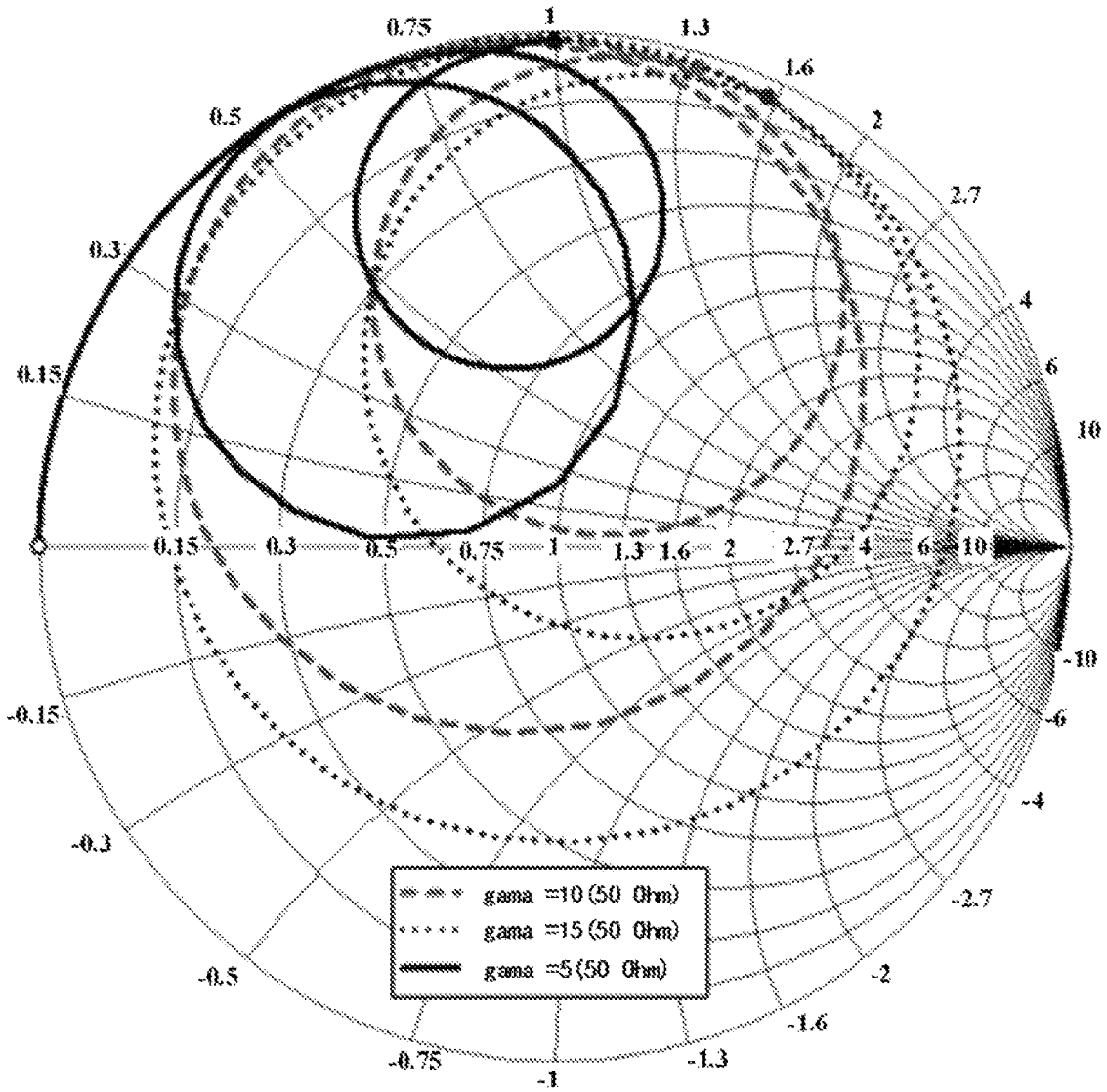
FIG. 8 is a schematic diagram of an impedance change curve of a feed point according to the disclosure.

FIG. 8 is a schematic diagram of an impedance change curve of the feed point consistent with the disclosure.

As shown in FIG. 8, the system impedance is 50 ohms, and the impedance shown at the center of FIG. 8 is a normalized value of the system impedance, which is 1 ohm. In order to improve the performance of the feed point, the γ can be adjusted such that the impedance of the feed point can be close to the system impedance or the normalized impedance of the system. The impedance of the feed point at γ=10 is closer to the system impedance than at γ=5 and γ=15, i.e., the performance of the feed point can be optimum when γ=10.

As shown in FIG. 8, the performance of the feed point can be adjusted according to γ, and the disclosure is not limited herein.

According to the disclosure, the position of the load circuit at the radiator can be determined based on the wavelength corresponding to the frequency band to be implemented by the load circuit, and the length of the second antenna can be further determined, such that the electronic device can radiate the RF signal of the frequency band using the second antenna.

In some embodiments, the first frequency band can be lower than the second frequency band.

In some embodiments, the length of the first antenna can be determined based on the wavelength corresponding to the first frequency band, and the length of the second antenna can be determined based on the wavelength corresponding to the second frequency band. Since the length of the first antenna is greater than the length of the second antenna, the wavelength corresponding to the first frequency band can be longer than the wavelength corresponding to the second frequency band. Based on an inverse relationship between frequency and wavelength, the first frequency band can be lower than the second frequency band.

Also in accordance with the disclosure, there is provided another electronic device. The electronic device can include the radiator providing with a circuit.

In some embodiments, the electronic device may include a mobile phone, a tablet, a notebook, a wearable device, or the like. The wearable device may include, for example, a smart watch, a wristband product, glasses, or the like, which are not limited herein.

According to the disclosure, the radiator refers to an object capable of emitting radiation. The radiation refers to that the radiator can transmit power outwardly through electromagnetic waves. The radiator may include, for example, the metal frame of the electronic device.

Consistent with the disclosure, the circuit can be arranged at the radiator. The circuit may include, but is not limited to, the load circuit, for example, the LC oscillating circuit.

The first antenna and the second antenna can be collectively referred to as a dual-band antenna.

It will be appreciated by those skilled in the art that the features described in the disclosure embodiments and/or the claims of the present disclosure can be combined in various combinations, even if such combinations are not explicitly recited in the present disclosure. The various features of the disclosed embodiments and/or claims of the present disclosure can be combined in various combinations without departing from the spirit and scope of the disclosure. All such combinations are within the scope of the disclosure.

Although the present disclosure has been shown and described with respect to the exemplary embodiments of the present disclosure, it will be apparent to those skilled in the art that various changes can be made to the form and detail of the present disclosure without departing from the spirit and scope of the disclosure. Therefore, the scope of the present disclosure should not be limited to the above-described embodiments, but should be determined not only by the appended claims but also by the equivalents of the appended claims.

What is claimed is:

1. An electronic device comprising:

a radiator;

a first antenna radiating a radio frequency (RF) signal of a first frequency band by using a first portion of the radiator;

a second antenna radiating the RF signal of a second frequency band by using a second portion of the radiator, the second portion including the first portion; and a load circuit arranged at the radiator as an end of the second portion, a first end of the load circuit being the end of the second portion, and a second end of the load circuit connecting to a second ground point of the electronic device;

a feed point shared by the first antenna and the second antenna; and a first ground point arranged at the radiator, wherein the first portion is between the feed point and the first ground point and the second portion is between the feed point and the load circuit, and wherein when the first antenna and the second antenna are in an operating state simultaneously, the load circuit is an open circuit to block the RF signal of the first frequency band radiated by the first portion and is simultaneously a short-circuit to pass the RF signal of the second frequency band radiated by the second portion, and the RF signal of the first frequency band and the RF signal of the second frequency band are radiated simultaneously and respectively along the first portion and the second portion of the radiator.

2. The device according to claim 1, wherein:

a position of the load circuit at the radiator is determined based on a frequency band to be implemented.

3. The device according to claim 2, wherein:

the position of the load circuit at the radiator is determined based on a wavelength corresponding to the frequency band to be implemented.

4. The device according to claim 1, wherein:

the first frequency band is lower than the second frequency band.

5. A dual-band antenna comprising: a first antenna portion radiating a radio frequency (RF) signal of a first frequency band by using a first portion of a radiator; and a second antenna portion radiating the RF signal of a second frequency band by using a second portion of the radiator, the second portion including the first portion, wherein: the first antenna portion and the second antenna portion share a same feed point arranged at the radiator; the first antenna portion is between the feed point and a first ground point arranged at the radiator; the second antenna portion is between the feed point and a load circuit arranged at the radiator, a first end of the load circuit being the end of the second portion, and a second end of the load circuit connecting to a second ground point of the electronic device; and when the first antenna portion and the second antenna portion are in an operating state simultaneously, the load circuit is an open circuit to block the RF signal of the first frequency band radiated by the first portion and is simultaneously a short-circuit to pass the RF signal of the second frequency band radiated by the second portion, and the RF signal of the first frequency band and the RF signal of the second frequency band are radiated simultaneously and respectively along the first portion and the second portion of the radiator.

6. The antenna according to claim 5, wherein:

the load circuit is an inductor-capacitor (LC) oscillating circuit open to the first frequency band and short-circuiting the second frequency band.

7. The antenna according to claim 5, wherein:

a position of the load circuit at the radiator is determined based on the second frequency band.

8. The antenna according to claim 5, wherein:

a position of the first ground point at the radiator is determined based on the first frequency band.

9. The antenna according to claim 5, wherein:

a position of a third ground point arranged at the radiator is used to adjust an impedance of the feed point.

10. An electronic device comprising: a radiator; and a dual-band antenna arranged at the radiator including: a first antenna portion radiating a radio frequency (RF) signal of a first frequency band by using a first portion of the radiator; and a second antenna portion radiating the RF signal of a second frequency band by using a second portion of the radiator, the second portion including the first portion, wherein: the first antenna portion and the second antenna portion share a same feed point arranged at the radiator; the first antenna portion is between the feed point and a first ground point arranged at the radiator; the second antenna portion is between the feed point and a load circuit arranged at the radiator, a first end of the load circuit being the end of the second portion, and a second end of the load circuit connecting to a second ground point of the electronic device; and when the first antenna portion and the second antenna portion are in an operating state simultaneously, the load circuit is an open circuit to block the RF signal of the first frequency band radiated by the first portion and is simultaneously a short-circuit to pass the RF signal of the second frequency band radiated by the second portion, and the RF signal of the first frequency band and the RF signal of the second frequency band are radiated simultaneously and respectively along the first portion and the second portion of the radiator.

* * * * *